United States Patent [19]

Jakowicki

[11] 4,051,562

[45] Oct. 4, 1977

[54] TILE CONSTRUCTION FOR A SWIMMING POOL

[76] Inventor: Henry Jakowicki, 123 Malts Ave., West Islip, N.Y. 11795

[21] Appl. No.: 734,328

[22] Filed: Oct. 20, 1976

[51] Int. Cl.[2] ..... E04H 3/16; E04H 3/18; F16L 22/02

[52] U.S. Cl. ..... 4/172; 4/172.15; 4/172.17; 4/172.19; 52/309.11

[58] Field of Search ..... 4/172, 172.15, 172.11, 4/172.17, 172.18, 172.19, 172.21; 52/309, 169 R, 169 DT

[56] References Cited

U.S. PATENT DOCUMENTS

| | | | |
|---|---|---|---|
| 2,490,272 | 12/1949 | Kascle | 4/172.19 |
| 2,816,329 | 12/1957 | Sogaro | 52/309 |
| 3,015,191 | 1/1962 | Lucchesi | 4/172.19 X |
| 3,289,370 | 12/1966 | Van Etten | 52/309 |
| 3,490,081 | 1/1970 | Ogden | 4/172.17 |
| 3,596,296 | 8/1971 | Gertz | 4/172.17 |
| 3,858,597 | 1/1975 | Pramenko | 4/172.17 |

*Primary Examiner*—Henry K. Artis

*Attorney, Agent, or Firm*—Posnack, Roberts & Cohen

[57] ABSTRACT

Tile construction for a swimming pool comprising an elongated tubular member having a longitudinal channel therein, and provided with a plurality of orifices extending into the channel and opening externally of the member. The orifices provide communication between the channel and the exterior of the tubular member. The tubular member has a flat outer surface adapted for constituting part of the wall surface of the pool and the orifices open in the vicinity of the flat outer surface. The tubular member is composed of two interengaged confronting sections and the tubular member can extend lengthwise along the pool so as to form a lane. A plurality of adjacent parallel lanes can be provided for racing purposes. A pump is connected to the channel for circulating overflow water back into the pool via the channel and the orifices in the tubular member. A plurality of tubular members can be used to form the wall or bottom of the pool or a deck for the pool for receiving overflow water to recirculate the water back to the pool.

27 Claims, 23 Drawing Figures

FINA
AAU

TILE CONSTRUCTION FOR A SWIMMING POOL

FIELD OF THE INVENTION

The invention relates to tile construction for a swimming pool comprising a tile tube which can serve as a marker, as a means for the circulation and storage of water in the pool and outside the pool (pool deck), as an air or gas bubbler, and as a lining for the walls and bottom of the pool.

BACKGROUND

In conventional swimming pools there is generally effected a circulation of water through filters with return of water to the pool via suitable inlets. These inlets can be wall inlets or bottom inlets. For best performance, the water is introduced through bottom inlets and it overflows at the top of the pool into a trench so as to be recirculated back to the inlets via filters and pumps.

It is necessary to used many spaced inlets which require the digging of a multitude of trenches beneath the pool and the placement of pipes in the trenches. A number of fittings are required between the pipes and the inlets and conventionally, these take the form of T's and L's etc. The concrete floor is then poured and a header or headers from the main supply line are joined to the pipes and thereby to the inlets. This involves a great deal of manual labor and frequently is found to have many problems. Thus, if the concrete should break, the lines themselves will also break and leakage will be consequently obtained. It is difficult to locate such leakage and also it is difficult to dig out the concrete and repair the same in sections.

In competition pools where racing takes place, it is necessary to provide racing lanes for the swimmers. These lanes are either defined by the use of ceramic tiles or the lanes are painted directly on the bottom of the pool as bottom markers, and on the walls as wall targets. Other suitable markers are safety lines, and for use in water polo and other games.

SUMMARY OF THE INVENTION

An object of the invention is to provide a tile construction in the form of a tile tube which will serve both for use as a lane marker in a competition pool while also providing for water circulation in the pool.

A further object of the invention is to provide such tile construction which is relatively inexpensive and provides a better distribution and diffusion of inlet water into the pool. Furthermore, the tile construction provides more effective and efficient means of water inlet and it is easier to control where the inlets are located.

In pools without racing lanes, the tile construction can be placed at the perimeter of the bottom of the pool and this will provide excellent inlet distribution of water.

In accordance with the invention, it is contemplated that the tile construction comprises an elongated member having a longitudinal channel therein, said member being provided with a plurality of orifices extending into said channel and opening externally of the member to provide communication between the channel and the exterior of the member, said member having an outer surface adapted for constituting part of the surface of the pool exposed to the water, said orifices being open in the vicinity of said outer surface.

Preferably, the elongated element comprises two interengaged confronting sections which are of identical cross-sections. The sections are extruded members and each includes a flange and depending webs and when the sections are placed into confronting juxtaposed relation, the webs interengage one another to form a tile tube.

In further accordance with the invention, a pump is associated with the tile tube for circulating water from the channel to the exterior of the tile tube via said orifices.

The tile tube preferably has a plurality of longitudinal channels arranged in transversely spaced parallel relation to one another and a header interconnects the channels and is coupled to the pump so as to circulate the water into the channels and thence, through the orifices into the pool.

The tile tube can be arrayed in parallel or perpendicular lines at the bottom of the pool to form required marking lanes and the tile tubes can be provided with characteristic markings in order to distinguish them from the remainder of the bottom of the pool. The tile tubes can also be employed on the walls to provide markings thereat and they can cover the bottom or walls of the pool.

A drain conduit can be provided at one end of the pool and channels of the tile tubes are connected in whatever number necessary to the drain conduit.

The tile tube can also serve as a gas or air bubbler in which case a source of compressed L.P. gas or an air compressor is connected to a tile tube and gas or air bubbles are introduced into the water in the pool via the orifices in the tile tube. Thereby, in the case of the air bubbles, the surface of the water can be broken up to allow a diver to see the water surface clearly and in the case of the gas bubbles the gas can be lighted for display effects. The tile tube can also serve to form the walls or bottom of the pool.

Additionally, the tile tube can serve to form a deck system for an overflow coping construction. A feature of this arrangement is the capability of the tile tubes for recirculating water and also for constituting a surge tank.

The tile tubes of the deck system can also be selectively employed to provide a spray section.

The tile tube, when constructed of CPCV, can also be used as inlets at the walls and/or floors of the pool for hot water for hot therapy treatment.

Further features and advantages of the construction according to the invention will become evident from the following detailed description which will be given in conjunction with the annexed drawings.

DETAILED DESCRIPTION

The invention will be described hereafter in relation to specific embodiments of the invention. It is to be appreciated, however, that the invention is not so narrowly restricted and can be employed in a variety of other ways which will become apparent to those skilled in the art.

Figures 1, 2, 3, 4:
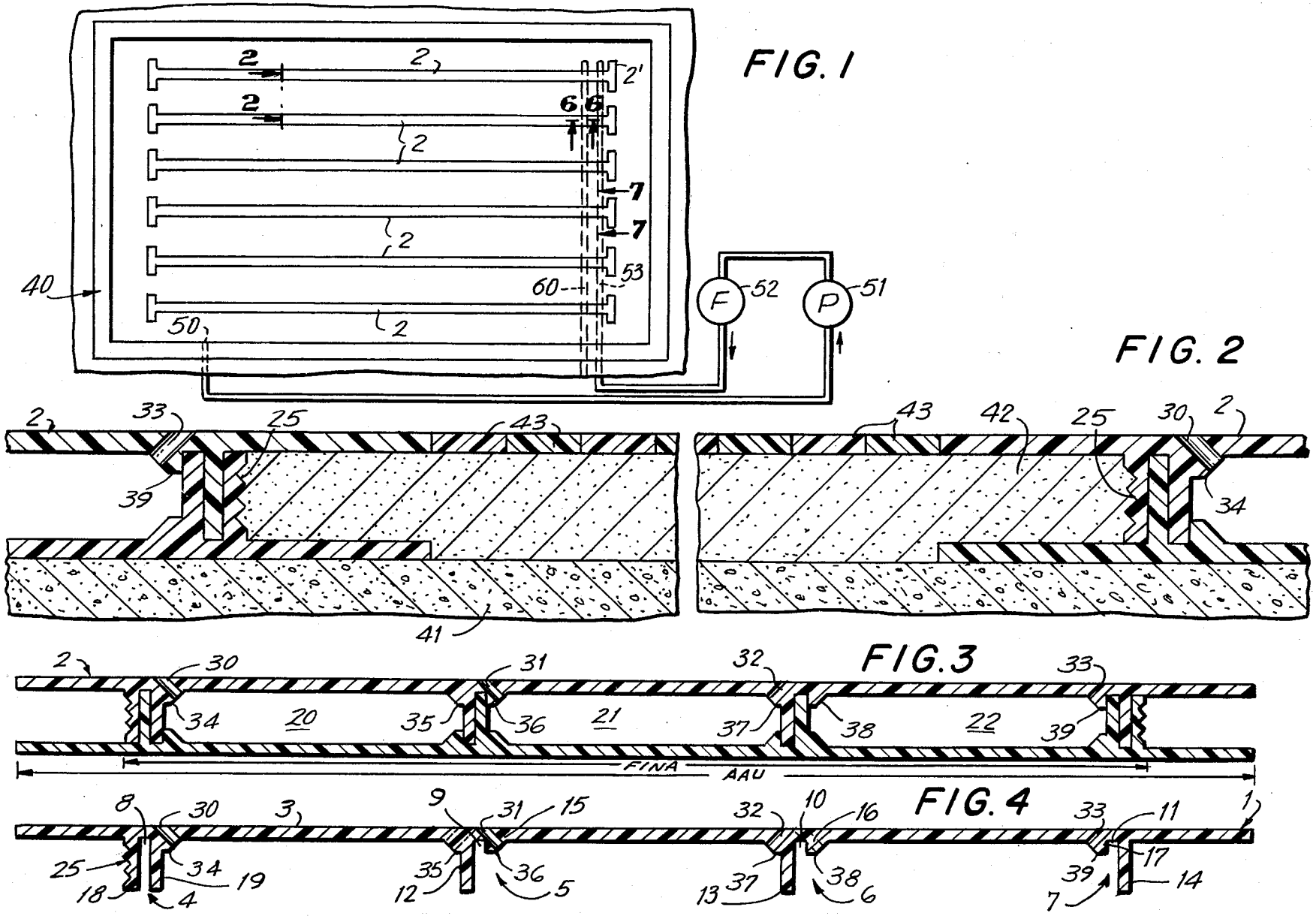
FIG. 1 is a diagrammatic plan view of a pool employing tile tubes according to the invention.
FIG. 2 is a sectional view taken on line 2—2 in FIG. 1.
FIG. 3 is a sectional view on a larger scale of one tile tuve of FIG. 2.
FIG. 4 shows one of the sections of the tile tube.

In a first embodiment, the invention is constituted by a tile element 1 of the form as shown in FIG. 4 for constituting a tubular tile member or tile tube 2 as shown in FIG. 3. The tile tube is employed in the embodiment of FIG. 1 both as an element for circulation of water in a pool and also as racing lanes at the bottom of the pool.

The tile element 1 of FIG. 4 is an extruded member which comprises a flange 3 with pairs of depending webs inclusive of one end pair 4 and a plurality of additional spaced pairs 5, 6, 7. Each of the pairs of webs defines respective slots 8, 9, 10, 11. Each of the web pairs 5, 6 and 7 comprises a respective longer web member 12, 13, 14 and a respective shorter web member 15, 16, 17. The web pair 4 includes web members 18 and 19 of substantially equal length.

As is evident from FIG. 3 when two identical sections are brought into confronting juxtaposed relation, the depending web of one section interengages into a corresponding slot of the other section to form the assembled tile tube. Such assembled tube includes, in the illustrated embodiment, three longitudinal channels 20, 21, 22.

The end webs 18 have outer surfaces 25 of saw-tooth shape for a purpose which will be explained later. For the present, however, it is to be noted that the tile tube in FIG. 3 has as its lateral edge surfaces the saw-tooth faces of opposite tile elements. The width of flange 3 conforms to the width established by the AAU and the distance between the saw-tooth faces of end webs 18 conform to the width of the racing lanes established by FINA. Thus in the case where the tile tube is to be used for a pool satisfying FINA standards, the portion of flange 3 overhanging the web 18 is severed from the rest of the flange. The description hereafter will proceed on the assumption of AAU standards although the use according to FINA standards will be obvious to those skilled in the art.

The extruded elements are constituted of a synthetic plastic resin material, such as, polyvinylchloride or CPVC, and in order to form the tile tube as shown in FIG. 3 it is only necessary to apply a suitable solvent adhesive to the web portions of the sections to be joined.

Either before assembly of the tile tube or after such assembly, one of the tile elements 1 is drilled with a series of holes 30, 31, 32 and 33. These holes extend longitudinally along the length of the tile tube and are disposed at suitable spaced intervals for effective distribution of water into the pool in a manner to be explained more fully hereafter. Instead of holes, there can be provided slots, adjustable orifices or combinations of any thereof disposed in any direction and at any angle. For the present, however, it is to be noted that the line of holes 31 and 32 in the two intermediate web pairs 5 and 6 extend alternately in opposite directions at inclinations of 30°-45° with respect to the horizontal. The line of holes 30 and 33 at the ends of the tile tube are all arrayed with the same inclination, the holes 30 and 33 being disposed in opposite directions also at 30°-45° with respect to the horizontal. It is to be noted that the webs are formed with inclined faces 34-39 at the locations where the holes are to extend through the element. In this way drilling of the holes can be facilitated prior to assembly of the elements to form the tile tube.

As seen in FIG. 1 a plurality of tile tubes 2 are arranged in longitudinal spaced relation along the length of a pool whose outline is diagrammatically indicated at 40. The tubes 2 can serve effectively as racing lanes at the bottom of the pool and for such purposes will be laterally spaced by a proper distance consistent with the standards established for racing pools.

Figure 13:
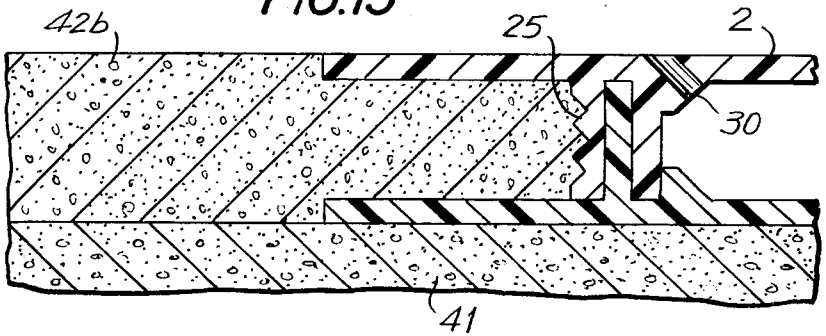
FIG. 13 is a sectional view showing a modification of a portion of FIG. 7.
Figure 12:
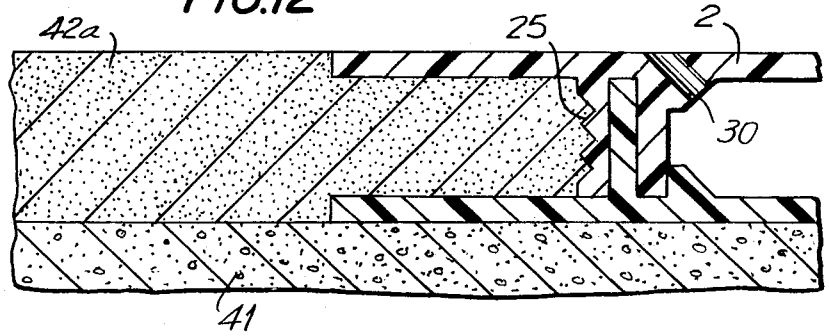
FIG. 12 is a diagrammatic plan view of a modified pool in which the tile tubes are employed for a deck.

The manner in which such a pool is fabricated will next be explained with reference to FIG. 2. Therein it can be seen that the pool 40 comprises a base 41 of concrete of the type conventially employed in the production of pools. The pool can also be constructed of steel or vinyl. The tile tubes 2 are placed at suitable transverse spacing on the base 41 and they can be adhesively secured thereto by means of a suitable adhesive such as "plastic bond" manufactured by Preco Industries Ltd. A ground coat or scratch coat 42 is laid on the base 41 between adjacent tile tubes 2 in order to lock the tubes in place so that they form permanent lanes. As an alternative, clips or other suitable means can be employed to fasten the tile tubes on the base. A combination of various of the above may be employed. After the tile tubes 2 have been secured to the base 1, a mortar is introduced between the tile tubes 2 approximately to the level of the lower surface of the upper flange thereof. As a consequence, the mortar will come into contact with the saw-tooth lateral surfaces 25 of the end webs to provide an effective locking juncture therebetween. Thereafter, conventional tiles 43 are placed on the mortar layer 42 so as to be flush with the upper surface of the tile element and thereby form a flat surface for the bottom of the pool. In a modification as shown in FIG. 12, marble dust plaster 42*a* is introduced between the tile tubes to form a flush surface with the upper surfaces of the tile tubes and the tiles 43 are omitted. In the modification shown in FIG. 13, concrete 42*b* is introduced between the tile tubes and its upper surface is also flush with the upper surface of the tile tubes. The upper surface is either painted or left in its natural color.

Figure 5:
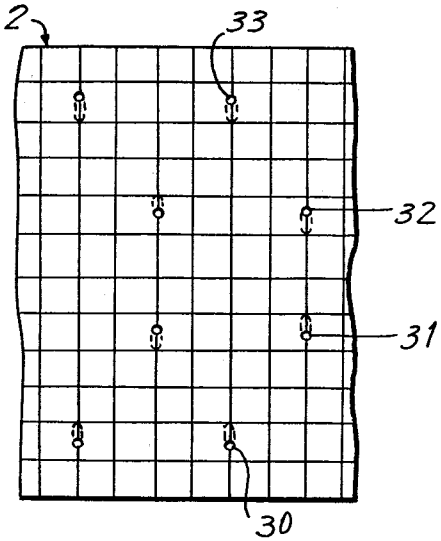
FIG. 5 is a plan view of a portion of one tile tube.

The upper surface of tile tube 2 can be formed with suitable marking means as seen in FIG. 5 or other non-slip finish so as to distinguish the same from the conventional tiles 43. Such marking means can be in a form of an embossed pattern on the surface of the tile element 2 which can be imprinted by a roller following the extrusion of the section 1. Preferably, the resinous material of the tile will be relatively dark, i.e., black, so as to be dinstinctly visible at the bottom of the pool to the swimmers.

Figure 11:
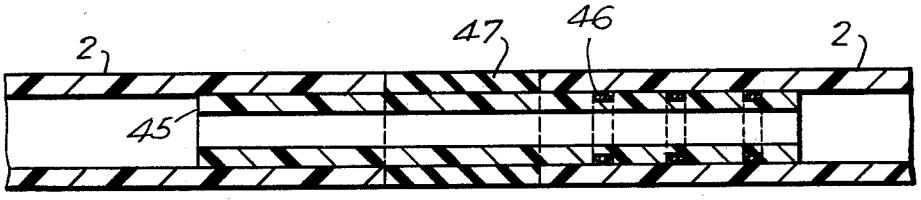
FIG. 11 is a longitudinal sectional view showing an espansion joint between two adjacent tile tubes.

The tile tubes can be formed in any length as desired and preferably the length of the will be of the order of twenty feet and the tubes will be suitably joined in face-to-face relation to provide longitudinal continuity between channels 20, 21 and 22 of the adjoining tubes for pools of greater length. Referring to FIG. 11 there it is shown a longitudinal sectional view of an expansion joint between two adjacent tile tubes 2 and wherein a connection tube 45 is introduced into respective channels of the adjoining tubes 2. The connection tube 45 is made of plastic and is solvent welded to one of the tile tubes by application of a suitable solvent thereto. At the other end the connection tube 45 carries a plurality of Teflon rings 46 which serve as seals and facilitate insertion of the connection tube into the associated tile tube 2. In the space between the two tubes, roughly of the order one-half an inch, there is interposed a suitable material 47 to permit expansion and contraction of the tile tubes 2. The material can be Thioseal or silicone filler.

As diagrammatically illustrated in FIG. 1, an overflow is provided at the periphery at the top of the pool into which water will flow and a water inlet 50 is connected to a pump 51 which the water through a filter 52 to a header 53 which is connected via respective inlets 54 with control valves 54' to individual channels of the tube tile. In this way continuous circulation of water is established in the pool. After water has been pumped through the inlets 54 into the channels 20, 21, 22 in the tile tubes, the water will traverse the channels and flow outwardly through the holes 30–33 into the pool. The alternating arrangement of the lines of holes 31 and 32 of each tile tube improves the mixing of the water into the pool while the inclination of the holes 30 and 33 at the ends of the tile tube tends to direct the water towards the laterally adjacent tile tubes.

Figure 10A:
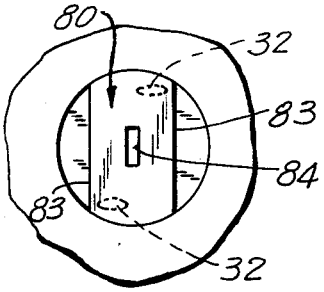
FIG. 10A-10C are diagrammatic plan views of the means shown in FIG. 9 for various degrees of adjustment.
Figure 10B:
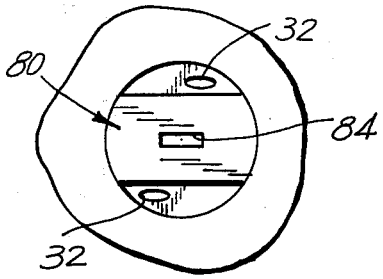
Figure 10C:
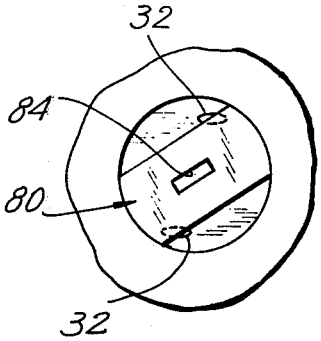

FIGS. 9 and 10A–10C show a control element 80 by which the degree of opening of the holes in the tile tubes can be regulated. The element 80 is tuneably mounted in the tile tube and includes a valve 81 mounted in a recess 82 in the flange in the tile tube at a location where two holes 32 are adjacent one another. The valve 81 has parallel sides 83 and as seen in FIG. 10A the angular position of the element can be such that the outlets of holes 32 are blocked. In FIG. 10B the element 80 is turned 90° and the outlets 32 are completely open. In FIG. 10C the element 80 is turned at an angle of 45° and the outlets of holes 32 are 50% open. The control element 80 is provided with a slot 84 in the surface of the valve to facilitate turning of the control element.

Figure 7A:
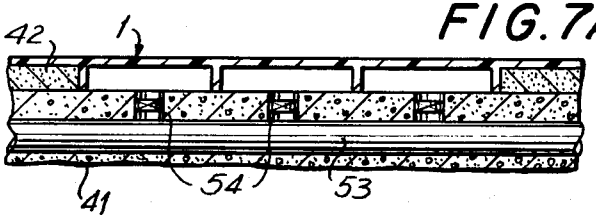
FIG. 7A is a diagrammatic sectional view of a modification in FIG. 7.
Figure 7:
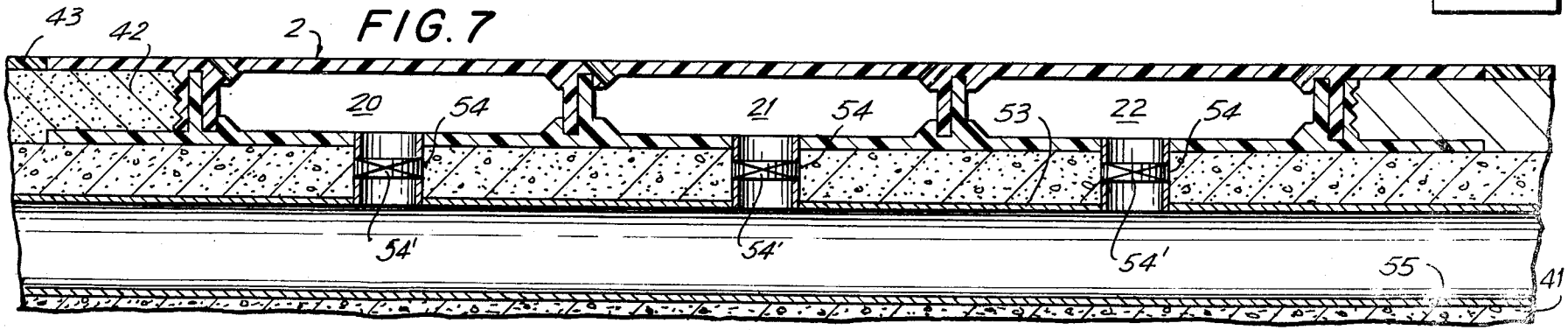
FIG. 7 is a sectional view taken on line 7—7 in FIG. 1.
Figure 9:
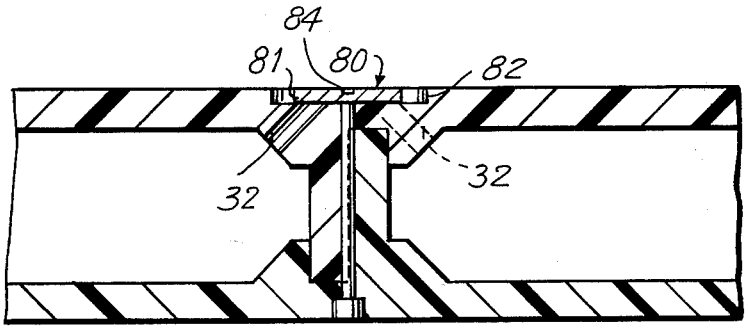
FIG. 9 is a sectional view through a portion or a tube showing means for adjusting the degree of opening of holes therein.

As evident from FIGS. 1 and 7, only a single header 53 is necessary for supply of recirculated water to all of the tile tubes 2. This obviates the need for a conventional network of a great number of pipes beneath the concrete base 41 of the pool for respective supply of water to the pool through individual inlets passing through the base of the pool as in the conventional constructions. As seen, the single header 53 is laid in a trench 55 and if it should become necessary to repair the header, this becomes a relatively simple matter since its location can be easily determined and suitable repairs made in contrast with a network of headers which are cast within the concrete base 41 as in the prior art.

Figure 6:
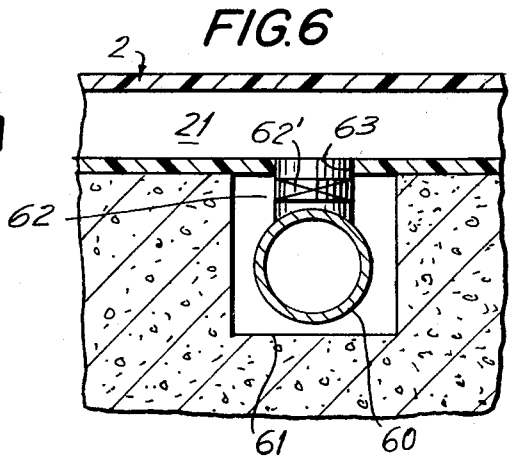
FIG. 6 is a sectional view taken on line 6—6 in FIG. 1.

For drainage purposes to empty the pool, there can be employed a single drain pipe 60 as shown in FIGS. 1 and 6 which runs transversely in a trench 61 beneath all of the lines of tube tiles 2. The drain pipe 60 is connected by means of respective connectors 62 incorporating control valves 62' to holes 63 extending into the central longitudinal channels 21 of each tile tube for drainage purposes. It is only necessary to open a valve at the outlet of drain tube 60 to permit the pool to be drained via the central channels of the longitudinal lines of tile tubes. As an alternative, a single central drain outlet can be connected to the tile tube at the center of the pool.

According to a modification, the drain can be employed for recirculation purposes in which case the drain is disposed at one end of the pool and the inlet header at the opposite end of the pool. The drain can be connected to the inlet of the pump and in this way approximately 10% of the water from the pool can be continuously in circulation.

Instead of forming a tile tube 2 from two interconnected elements 1 as shown in FIGS. 2 and 7, a single tile element 1 can be employed as shown in FIG. 7A and placed on base 41 and sealably locked in place by scratch coat 42 whereby longitudinal channels will be formed communicating with header 53 via inlets 54.

Although the invention has been described hereinabove with regard to the use of the tile tubes for racing lanes, it is to be understood that when there are no racing lanes, the tile tubes can be disposed around the perimeter of the pool as wall or bottom inlets or other markings solely for the purpose of effective circulation of water in the pool.

Each of the lines of tile tube is provided at its extremities with a crosswise T arrangement of a tile tube in the manner as shown at 2' in FIG. 1 in accordance with FINA, AAU, NCAA, CNCA and other codes.

In lieu of an individual drain pipe 60 and individual connectors 62, a grating can be placed and filled between tile tubes 2 at the top of trench 61 and the drain holes 63 in the central longitudinal channels 21 of the tile tubes can lead directly into the trench 61. The outlet of the drain can be valved in any suitable manner and, for example, by means of a displaceable valve plate or the like.

It is also contemplated that the tile tubes can be employed with coping around the edge of the pool to collect water from a deck of the pool namely, through the holes 30–33 for drainage via longitudinal channels 20–22. This will be described in greater detail later.

Figure 8:
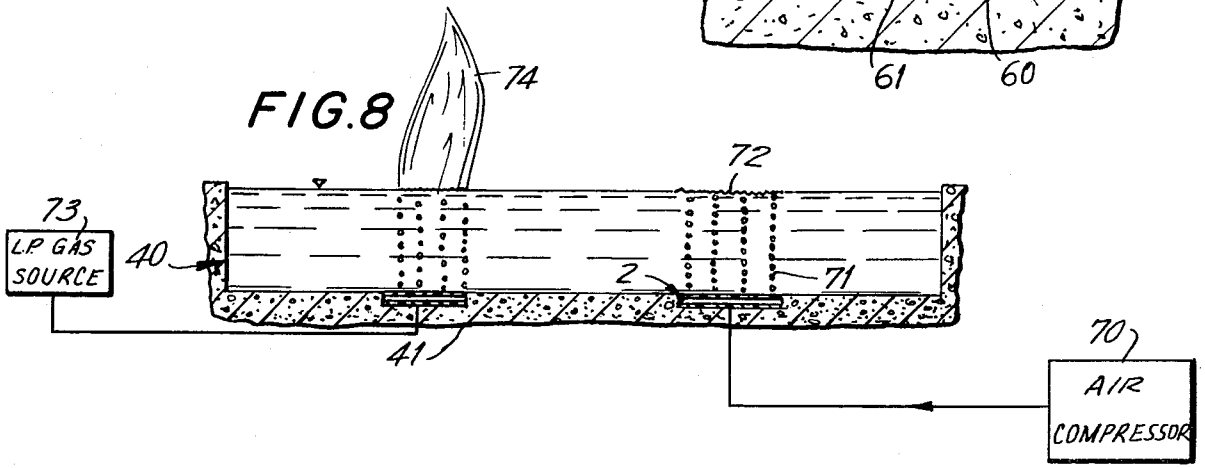
FIG. 8 is a diagrammatic longitudinal sectional view showing the tile tube used as an air and as a gas bubbler.

According to further uses of the tile tube of the invention, reference is made to FIG. 8 wherein one tile tube is shown diagrammatically connected to an air compressor 70. Such tile tube is intended to distribute bubbles of air into the pool as shown at 71 via the holes 30–33, in order to produce a ripple effect 72 at the surface of the water. This is undertaken to allow a diver to see the surface of the water in diving pools. Of course, such air compressor 70 will be connected to one or more tile tubes 2 under each diving board at the deep end of the pool where the diving usually takes place. Also shown in FIG. 8 is the connection of an LP gas source 73 to a tile tube 2 for introducing gas into the pool, said gas bubling through the water and being lighted at the top surface thereof for display effects, e.g. the production of a flame 74 at the surface of the pool.

The construction of the tile tube according to the invention is effective to provide better and more effective distribution of liquid, air or gas into the pool, resulting in higher diffusion efficiency. Furthermore, it is simple to control the location of the inlets since only a single line thereof is generally necessary. Indeed, even if a plurality of inlet conduits are provided, their location can be exactly determined.

It is further noted that racing lanes formed by tile tubes are generally closer than normally required for inlet distribution. As a consequence, extremely effective and uniform distribution of water can be obtained.

It should also be noted that the tile tubes can be employed on the walls of the pool as a supplement or as a wall distribution means for water or air as desired.

Figure 14:
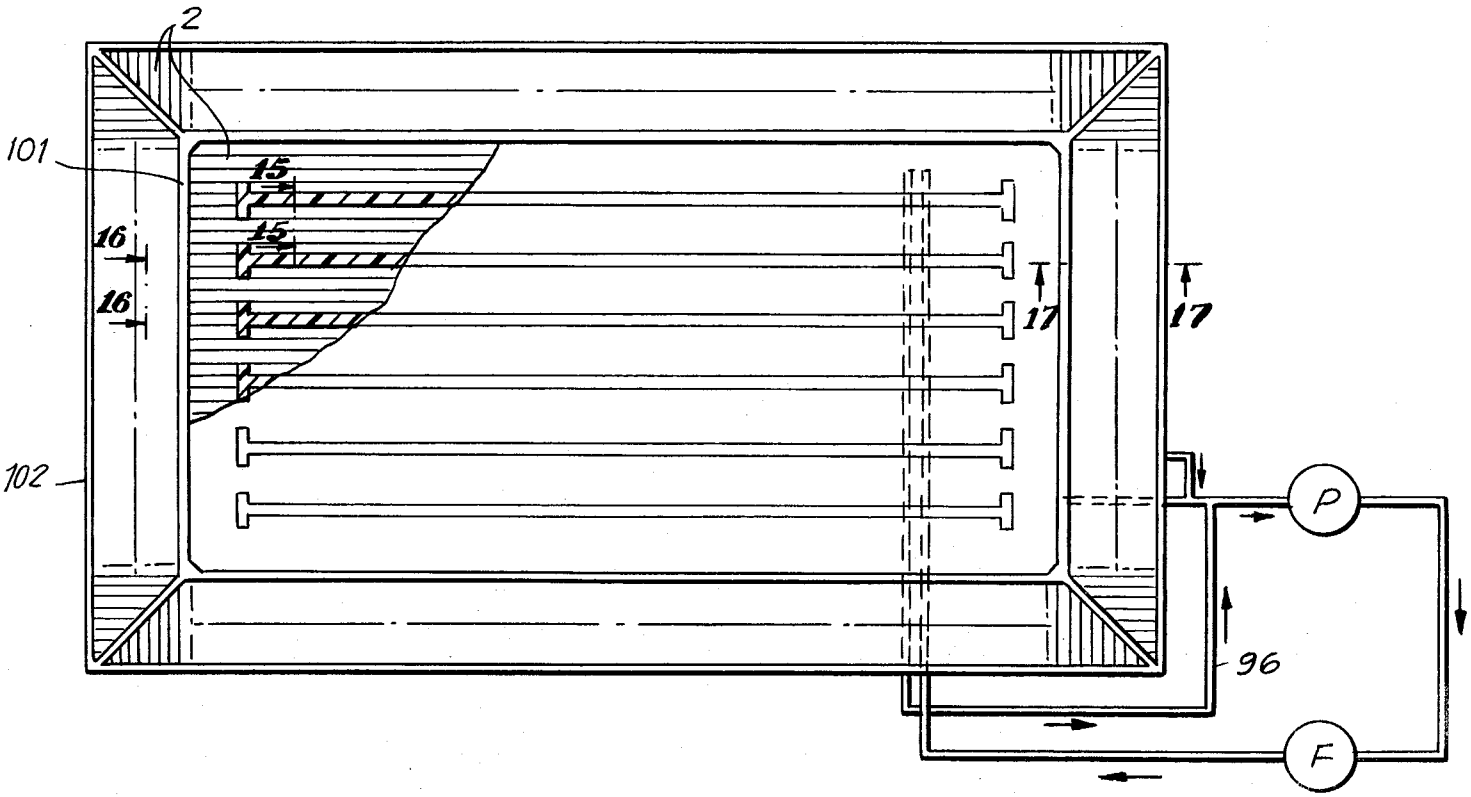
FIG. 14 is a sectional view showing another modification of a portion of FIG. 7.
Figure 15:
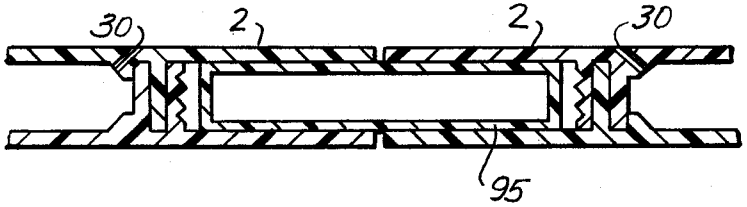
FIG. 15 is a diagrammatic sectional view taken on line 15—15 in FIG. 14.

Reference is next made to FIG. 14 which shows a diagrammatic plan view of a modified pool and therein can be seen the pool surrounded by a coping 101 and a deck 102. Furthermore, in this embodiment it will be seen that the bottom of the pool is composed in entirety by tile tubes 2 which are placed adjacent one another and suitably interconnected. Thus, with reference to FIG. 15 therein can be seen adjacent tile tubes 2 which are spaced from one another by a relatively small distance of the order of one-sixteenth of an inch and wherein a longitudinal bracing member 95 is interposed between the adjacent tile tubes and adhesively secured thereto. The circulation path for the water is shown in FIG. 14 and therein the pump P circulates water from overflow in a manner which will be explained more fully later through the filter back into the pool. In this embodiment 10% of the circulating water is removed from the pool bottom and conveyed through conduit 96 to the inlet of the pump. The hydraulic system is designed so that the water flow will provide optimum flow diffusion. The current requirements for construction of swimming pools in many jurisdictions require the presence of a gutter which will be capable of continuously removing at least 90% of the recirculated water for return to the filter. Furthermore, all such gutter pools must have a surge capacity for example, of the order of one gallon per square foot of pool area as promulgated in New York state, and also by NSPI "Minimum Standards for Public Pools," Paragraph 12.7.4. Current requirements also call for the provision of a continuous deck extending a minimum of 10–10 completely around the pool. As seen in FIGS. 14 and 15 the deck is composed of juxtaposed tile tubes 2 which serve as a support surface and also as a perforate surface which will allow recirculation of water in the hydraulic circuit as will be explained more fully later.

Figure 16:
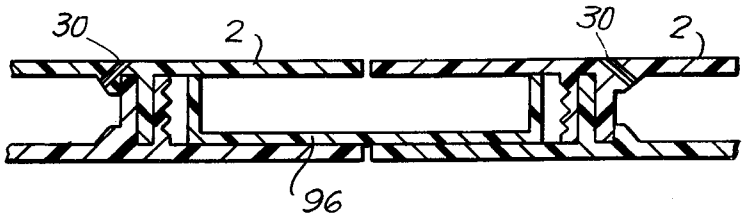
FIG. 16 is a sectional view taken on line 16—16 in FIG. 14.

FIG. 16 shows the provision of juxtaposed tile tubes 2 which are braced and supported by an open channel member 96 of thermoplastic material secured to the adjacent tile tubes. The tile tubes are spaced apart by a minimum distance of the order of one sixteenth of an inch.

Figure 17:
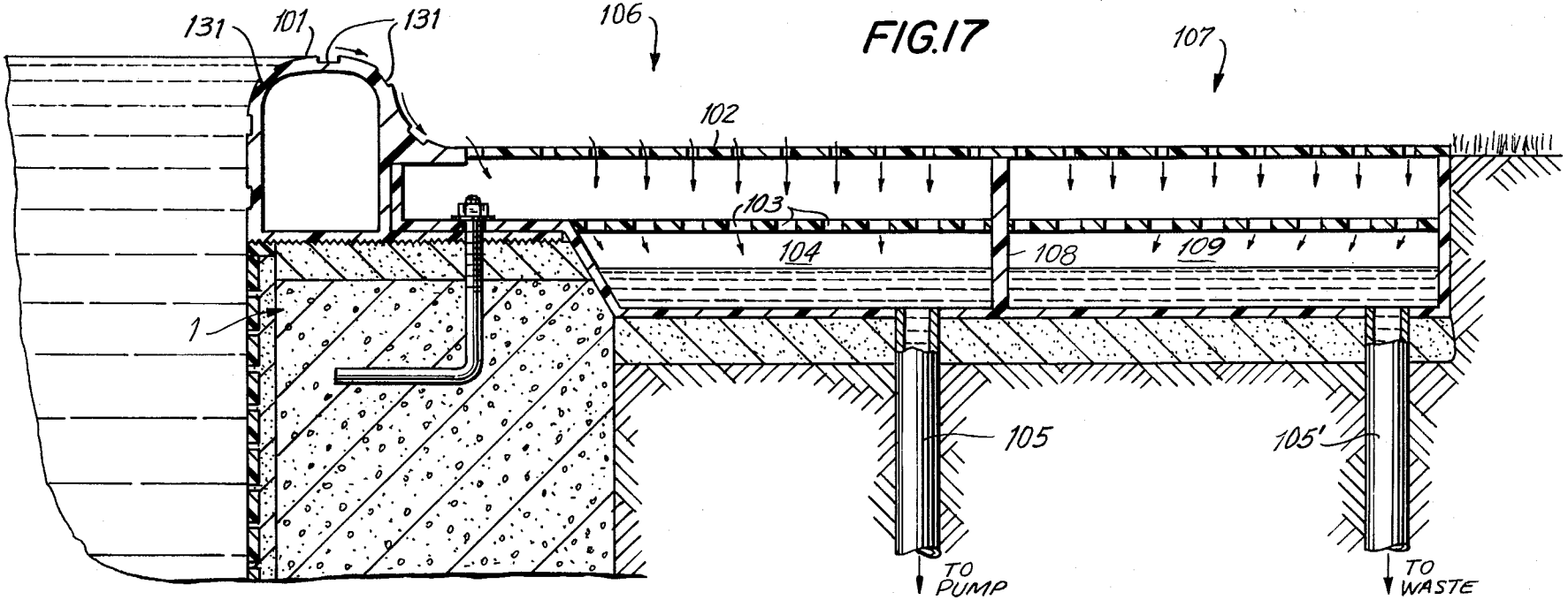
FIG. 17 is a sectional view taken on line 17—17 in FIG. 14.

Referring to FIG. 17 wherein a diagrammatical sectional view is shown to illustrate the surge capacity of the construction, the coping 101 is shown mounted on the wall 1 of the pool, the coping being constituted as a hollow member made, for example, of PVC, ABS resin, or reinforced fiber glass. The level of water in the pool is higher than that of the upper edge of the coping 101 so that water continuously overflows the coping onto the deck 102. The coping is formed with notches 131 extending along the length of the coping to provide a convenient gripping surface for a swimmer coming out of the pool and for reducing the speed of flow of the water over the coping and minimizing noise. The deck is composed of the tile tubes which are perforated at their upper flange and formed with a nonslip surface by the embossing or similar treatment as previously explained. Thereby, the overflow water travels through the apertures in the upper flange of the tile tubes and flows into the longitudinal channels therein. The water flows through large apertures 103 provided in the bottom of the lower flange of the tile tubes and thence into a reservoir 104 whose outlet 105 is connected to the pump P. The deck is divided into two sections 106 and 107 separated by a partition 108 which acts to prevent commingling of water passing in sections 106 and 107. The section 106 will essentially receive overflow water from the pool whereas section 107 will receive splashed water by the bathers along with some overflow water. This mixture of the splashed water and overflow water is conveyed to a chamber 109 which has an outlet 105' leading to waste.

Figure 18:
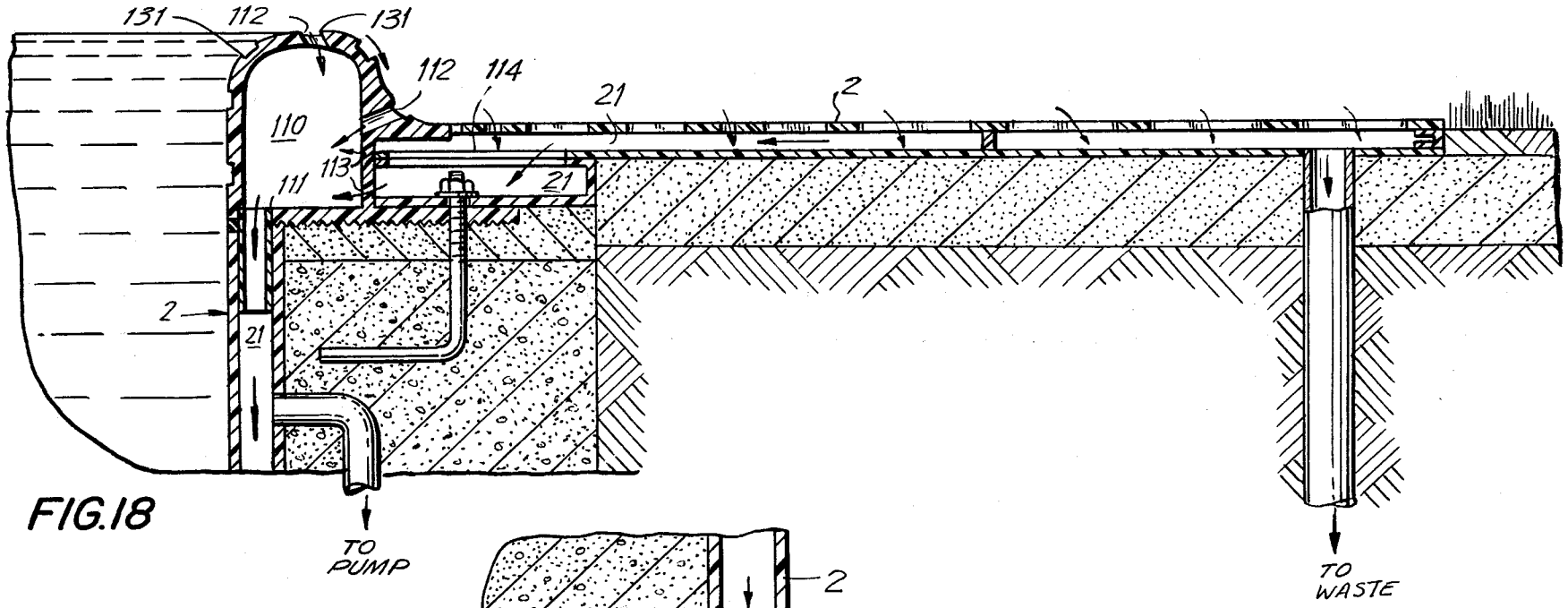
FIG. 18 shows a modification of the construction in FIG. 17.

FIG. 18 shows a modified arrangement of the construction in FIG. 17 and herein instead of a separate reservoir 104, the flow within the channels of the tile tubes is fed into the hollow interior 110 of the coping and conveyed along longitudinal channels in vertical tile tubes 2 which are laid on their ends along the side walls of the pool. As seen, the vertical tile tubes 2 are joined to a common manifold 111 which connects the channels of the tile tubes to the interior 110 of the coping. The longitudinal channels are also connected to a suitable outlet conduit as, for example, in the manner as shown in FIG. 6, said outlet conduit extending to pump P. As evident in FIG. 18 the coping is provided with apertures 112 along the periphery thereof for direct inlet of fluid therein. Near its base the coping is provided with transverse slots 113 to allow flow of liquid from the interior of the channels 20–22 of the tile tubes forming the deck into the interior 110 of the coping. As seen immediately to the right of the coping in FIG. 18, two tile tubes 2 of different lengths are superimposed on one another and these tile tubes are solvent welded along their adjoining surfaces and formed with relatively large openings 114 respectively in their lower and upper flanges which are in registry with one another and define an outlet for the overflow liquid in the upper tile tube for conveyance to the interior of the coping and thence to the pump.

Figure 19:
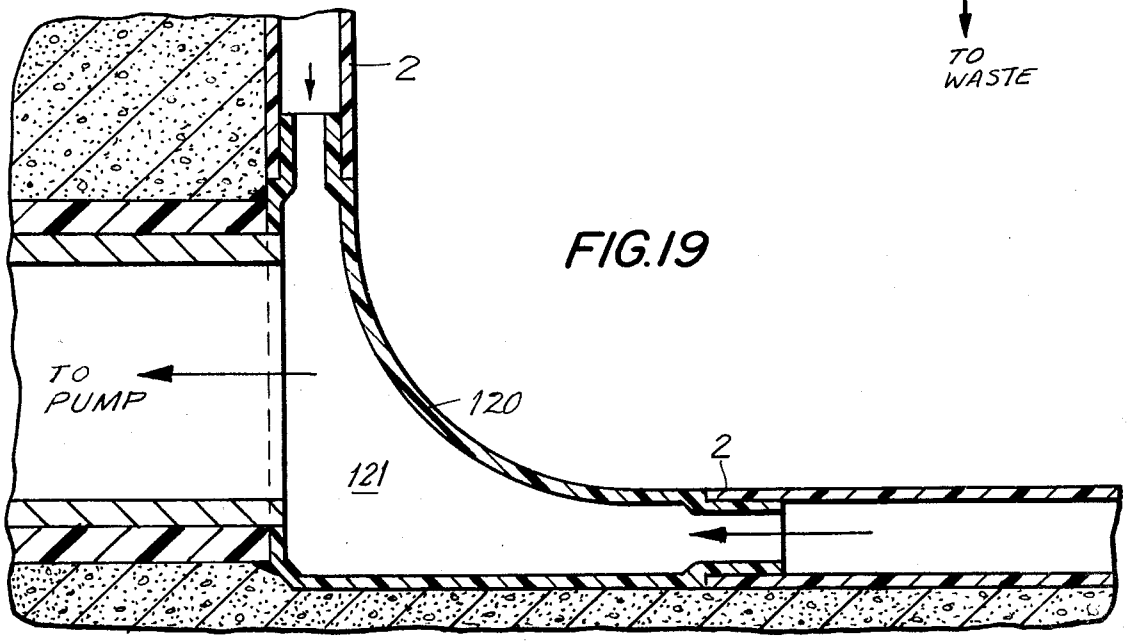
FIG. 19 is a sectional view of a modification of the bottom corner portion of the pool taken on line 17—17 in FIG. 14.

FIG. 19 shows the arrangement of FIG. 18 and wherein the tile tubes 2 at the bottom of the pool are connected to the outlet of the vertically placed tile tubes 2 at the end wall of the pool which receives the water from the interior of the coping. As seen in FIG. 19 a hollow curved member 120 is disposed at the bottom corner at the end wall and this curved member 120 defines a hollow interior 121 which communicates with the longitudinal channels in the tile tubes of the end wall and with the longitudinal channels at the bottom of the pool. The hollow interior 121 is connected to the pump inlet and thereby the overflow water will be recirculated along with water from the interior of the pool. The water which is taken from the interior of the pool can be suitably controlled by valves to represent 10% of the recirculating flow as previously explained with respect to FIG. 14.

It is to be understood that the upper surface of the tile tubes forming the deck must be perforate and non-slip, and for this purpose the surface can be either treated or embossed as previously explained. The apertures in the surface of the tile tubes can be adjustable in the manner as previously explained with respect to FIGS. 9 and 10A–10C. It is to be appreciated that in lieu of holes 30–33 elongated slots or any other form of opening with or without adjustment means can also be provided. The size of these slots and holes is such as to minimize the likelihood of penetration by toes and fingers.

Individual tile tubes in the deck or at other locations in the pool can be suitably employed as "dry" channels for electrical conduits, wires and cables for racing timing systems and underwater speakers, PA systems or the like. These tile tubes will be isolated from tile tubes through which water flows.

Figure 20:
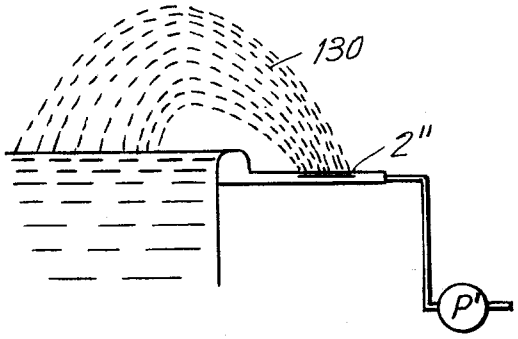
FIG. 20 is a diagrammatic illustration showing a further use of a tile tube.

Referring to FIG. 20 therein is shown another use for a selected tile tube and herein a pump P′ is connected to a selected tile tube or tile tubes 2″ for pumping water therein so that the water will be discharged through the holes in the tile tube in the form of a spray 130 through which the swimmers may pass before going into the pool as desired. The spray 130 may serve as a means for filling the pool with aerated water or as a display fountain.

The use of the tile tubes as inlets or as a main drain obviously will permit substantially reduced orifice diameters as compared to a localized inlet or drain without compromise of the open free area for discharge or supply. This also will result in substantial elimination of the danger of catching fingers, toes, hair, bathing suits etc. in slots or orifices particularly in wading and diving pools as compared to the previous pool building art.

By constructing the deck of tile tubes as shown hereinabove there is substantially no water accumulation on the surface of the deck and it is virtually dry at all times. Furthermore, no other concrete deck is required above and beyond that of the deck formed by the tile tubes. Moreover, no concrete support will be necessary under the full length of the tile tube deck as it will be merely sufficient to employ a compacted granular base.

Furthermore, the top flange of the tile tubes which form the deck can be made from a porous material thereby completely eliminating the need for holes and slots in the upper flange.

Furthermore, due to the use of a thermoplastic material which is electrically insulative there is no need for electrical grounding of the pool. Moreover, the material is non-corrosive and non-staining even for salt water pools. Additionally, it should be noted that the tile tubes can have various colors and textures and be capable of providing any desired deck.

More significantly, the tile tubes will serve to store the overflow water and hence constitute the required surge capacity as set forth by the codes as previously noted.

It is further to be noted that by forming openings in the webs of adjoining longitudinal channels and by providing partitions between selected webs, any desired change in direction of flow, flow rate, pressure or velocities of the water can be obtained. As a consequence, a whole network of channels for example, for the entire pool bottom or walls can be obtained by single inlet or outlet connection.

Although the invention has been described with reference to specific embodiments thereof, it will become obvious to those skilled in the art that numerous modifications and variations can be made without departing from the scope and spirit of the invention as defined in the attached claims.

What is claimed is:

1. Tile construction for a swimming pool comprising an elongated member having a longitudinal channel therein, said member being provided with a plurality of orifices extending into said channel and opening externally of the member to provide communication between the channel and the exterior of the member to provide a flow path for a fluid, said member having an outer surface adapted for constituting part of the surface of the pool, said orifices being open in the vicinity of said outer surface.

2. A tile construction as claimed in claim 1 wherein said member comprises two interengaged confronting sections.

3. A tile construction as claimed in claim 1 comprising means for adjusting the degree of opening of said orifices.

4. A tile construction as claimed in claim 2 wherein said sections are extruded and each has a flange with depending webs.

5. A tile construction as claimed in claim 3 wherein said sections are extruded and each has a flange with depending webs.

6. A tile construction as claimed in claim 5 wherein said flange has an outer surface adapted to form said outer surface of the element.

7. A tile construction as claimed in claim 6 wherein said sections are constituted of a synthetic resinous thermoplastic material.

8. A tile construction as claimed in claim 7 wherein said material is PVC, CPVC or fiberglass.

9. A tile construction as claimed in claim 6 wherein said depending webs are arrayed in spaced pairs, each pair defining a space therebetween such that when two sections are placed in confronting juxtaposed relation, the web of one pair penetrates into the space between the webs of another pair.

10. A tile construction as claimed in claim 9 wherein said webs in selected pairs are of different length.

11. A tile construction as claimed in claim 9 wherein said orifices are disposed in said flanges adjacent said webs.

12. A tile construction as claimed in claim 1 wherein said channel has a longitudinal axis, said orifices being arranged along a longitudinal line and being successively inclined in different directions relative to said longitudinal axis.

13. A tile construction as claimed in claim 1 wherein said member has a plurality of said longitudinal channels arranged in transversely spaced parallel relation.

14. A tile construction as claimed in claim 1 in combination with pump means for circulating water between the channel and the exterior of the member.

15. The combination as claimed in claim 14 wherein said member has a plurality of longitudinal channels arranged in transversely spaced parallel relation to one another, and a header interconnecting said channels and coupled to said pump means.

16. The combination as claimed in claim 14 wherein a plurality of said members are provided and are disposed parallel to one another in transverse spaced relation at the bottom of the pool, said outer surface of the said members having characteristic marking means to distinguish said surfaces to form distinct lanes.

17. The combination as claimed in claim 16 wherein said header interconnects the channels of all of said members with said pump.

18. The combination as claimed in claim 17 comprising a drain conduit and means connecting at least one channel of one member with said drain conduit.

19. A tile construction as claimed in claim 1 in combination with an air compressor connected to said channel for circulating air through said orifices into the pool to produce bubbling at the surface of the water in the pool.

20. A tile construction as claimed in claim 1 in combination with a source of an ignitable gas connected to said channel for circulating gas through said orifices into the pool to produce gas bubbling at the surface of the water in the pool which can be ignited for display effects.

21. A tile construction as claimed in claim 1 wherein the pool has a deck, said deck being constituted by a plurality of said elongated members arranged adjacent one another and adapted for receiving via said orifices, overflow water from the pool.

22. A tile construction as claimed in claim 21 wherein the pool has a reserve tank beneath said deck communicating with the water in the pool, the channels of the members being connected to said reserve tank.

23. The combination as claimed in claim 1 wherein the pool has a deck constituted by a plurality of said members forming said surface.

24. The combination as claimed in claim 23 wherein said pool has a coping over which water flows onto said deck and through the orifices into the channels of the members, and pump means for circulating the water from the channels back into the pool.

25. The combination as claimed in claim 24 wherein the channels of said members collectively define a volume which will store a desired quantity of water in relation to the volume of water in the pool.

26. The combination as claimed in claim 25 wherein the pool has a wall constituted at least in part by said members which communicate with said volume of the channels of said members of the deck.

27. The combination as claimed in claim 26 wherein the pool has a bottom constituted at least in part by said members which communicate with the channels of the members of the wall.

* * * * *